US010828858B2

(12) United States Patent
Gontkosky et al.

(10) Patent No.: US 10,828,858 B2
(45) Date of Patent: Nov. 10, 2020

(54) SERVO-DRIVEN FORMING PRESS

(75) Inventors: Leo Gontkosky, Northampton, PA (US); Barry B. Hunsberger, Bath, PA (US)

(73) Assignee: GPCP IP Holdings LLC, Atlanta, GA (US)

( * ) Notice: Subject to any disclaimer, the term of this patent is extended or adjusted under 35 U.S.C. 154(b) by 821 days.

(21) Appl. No.: 11/690,261

(22) Filed: Mar. 23, 2007

(65) Prior Publication Data

US 2008/0234119 A1 Sep. 25, 2008

(51) Int. Cl.

| | |
|---|---|
| ***B31B 70/00*** | (2017.01) |
| *B31B 50/14* | (2017.01) |
| *B31B 50/59* | (2017.01) |
| *B31B 160/10* | (2017.01) |

(52) U.S. Cl.

CPC ..... *B31B 70/00* (2017.08); *B31B 50/142* (2017.08); *B31B 50/592* (2018.05); *B31B 2160/10* (2017.08)

(58) Field of Classification Search

CPC ..... B31B 2201/2666; B31B 3/00; B31B 1/46; B31B 1/44; B31B 2201/2654; B31B 2201/223; B31B 43/00; B31B 2201/295; B31B 2203/003; B31B 70/00; B31B 2160/10; B31B 50/592

USPC ..... 493/143, 152, 145, 146, 147, 149, 171, 493/169, 180, 902

See application file for complete search history.

(56) References Cited

U.S. PATENT DOCUMENTS

| | | | | |
|---|---|---|---|---|
| 3,318,748 | A | 5/1967 | Hurst | |
| 3,797,368 | A * | 3/1974 | Martelli | 493/197 |
| 3,824,058 | A * | 7/1974 | Axer et al. | 425/338 |
| 3,949,655 | A * | 4/1976 | Gold | 493/32 |
| 4,079,664 | A * | 3/1978 | Jones | 493/156 |
| 4,242,293 | A * | 12/1980 | Dowd | 264/40.7 |
| 4,427,476 | A * | 1/1984 | Beck et al. | 156/199 |
| 4,435,143 | A * | 3/1984 | Dempsey | 425/150 |
| 4,588,539 | A | 5/1986 | Rossi et al. | |
| 4,636,348 | A * | 1/1987 | Whiteside | 264/544 |
| 4,778,439 | A * | 10/1988 | Alexander | 493/169 |
| 4,832,676 | A * | 5/1989 | Johns et al. | 493/152 |
| 5,195,435 | A * | 3/1993 | Morrone et al. | 101/151 |
| 5,249,946 | A | 10/1993 | Marx | |

(Continued)

FOREIGN PATENT DOCUMENTS

| | | |
|---|---|---|
| DE | 4109796 A1 | 10/1992 |
| EP | 0503800 A1 | 9/1992 |

(Continued)

OTHER PUBLICATIONS

International Search Report and Written Opinion of the International Searching Authority dated Jul. 30, 2008 in connection with PCT/US2008/056470.

(Continued)

*Primary Examiner* — Sameh Tawfik

(57) ABSTRACT

A forming apparatus for producing paperboard pressware includes servo-driven blanking and product forming subsystems, and a computerized control system to provide independent control of the servo-driven subsystems for improved timing and positional accuracy. Independent and individual electronic control of the various component subsystem enables remote control and monitoring of production and machine functions.

34 Claims, 5 Drawing Sheets

(56) References Cited

U.S. PATENT DOCUMENTS

| | | | | |
|---|---|---|---|---|
| 5,357,731 | A * | 10/1994 | Conway et al. | 53/374.4 |
| 5,588,344 | A | 12/1996 | Chun | |
| 5,761,886 | A * | 6/1998 | Parkhideh | 53/454 |
| 6,527,687 | B1 | 3/2003 | Fortney et al. | |
| 6,592,357 | B1 | 7/2003 | Johns et al. | |
| 6,845,645 | B2 * | 1/2005 | Bartrom et al. | 72/15.5 |
| 6,871,586 | B2 * | 3/2005 | Teraoka | 100/49 |
| 7,066,869 | B2 * | 6/2006 | Cook et al. | 493/69 |
| 7,234,337 | B2 | 6/2007 | Nagae | |
| 7,165,490 | B2 | 11/2007 | Futamura et al. | |
| 7,293,500 | B2 | 11/2007 | Futamura et al. | |
| 7,434,505 | B2 | 10/2008 | Suzuki et al. | |
| 8,734,309 | B2 * | 5/2014 | Johns | B31B 70/00 493/152 |
| 2002/0132717 | A1 | 9/2002 | Weder et al. | |
| 2005/0192171 | A1 | 9/2005 | Grischenko et al. | |
| 2005/0204798 | A1 * | 9/2005 | Imaeda | 72/443 |

FOREIGN PATENT DOCUMENTS

| | | | |
|---|---|---|---|
| JP | 55164145 | A | 12/1980 |
| JP | H05208463 | A | 8/1993 |
| JP | 2000326426 | A | 11/2000 |
| JP | 2005271281 | A | 10/2005 |
| WO | 2005110727 | A1 | 11/2005 |

OTHER PUBLICATIONS

English translation of DE 4109796 A1, publication date Oct. 1, 1992, Burger.

* cited by examiner

SERVO-DRIVEN FORMING PRESS

TECHNICAL FIELD

The present invention relates generally to press forming systems for manufacturing.

BACKGROUND

Die-press forming systems are used in the manufacture of a variety of shaped products. For example, U.S. Pat. No. 4,588,539 to Rossi et al, U.S. Pat. No. 5,249,946 to Marx, U.S. Pat. No. 6,527,687 to Fortney et al, U.S. Pat. No. 6,592,357 to Johns et al, and U.S. Patent App. Pub. No. US2005/0192171 A1, are all incorporated herein by reference to provide a general background understanding of known press forming systems for production of paperboard pressware products such as plates, bowls and the like.

Conventionally, a single large motor coupled to a bullgear drives the entire press forming apparatus. Paperboard blanks are gravity fed from the blanking station into the forming die. Mechanical systems incorporating gears, belts, timing chains, cams, and/or mechanical encoders and switches typically couple the drive motor to the forming ram, the blanking die, the paper feed, the product knockout and scrap discharge, and other components of the press forming apparatus.

Such mechanical systems often require considerable maintenance and adjustment to maintain proper timing and operation of the various stages of the product forming process. Also, stacking of tolerances in a series of mechanical components within a drivetrain may result in timing and locational inaccuracies, which can negatively affect product quality. In addition, independent adjustment of stroke distances, dwell times, applied pressure, and other aspects of the forming sequence are somewhat limited in mechanically linked systems, because of the coupling of the various components to a common drive motor. Attempts to increase production rates generally demand shorter cycle times, which can amplify many of the shortcomings of mechanical drive systems.

Accordingly, it can be seen that improvements to the drive and control systems of a forming press are highly desirable. It is to the provision of improved forming press systems meeting these and other needs that the present invention is primarily directed.

SUMMARY OF THE INVENTION

The present invention provides an improved press forming system for producing articles such as paperboard pressware. In particular embodiments of the invention, independent actuators such as servo motors are provided for component subsystems of the press forming system. For example, independent actuators can drive one or more of the paper-unwind, blanking, blank-feeding, forming, and/or product discharge components of a paperboard pressware forming system In example forms of the invention, a computer control system linked to the independent actuators provides improved timing and locational accuracy in the press forming operation, permits independent adjustment of the components, and enables improved quality and increased production rates.

In one aspect, the invention is a press forming system. The press forming system includes a blanking die for forming paperboard blanks, wherein the blanking die is driven by a first controllable actuator. The press forming system also includes a forming die for receiving the paperboard blanks from the blanking die and forming paperboard pressware, wherein the forming die is driven by a second controllable actuator. The press forming system also includes a control system providing independent control of the first and second controllable actuators.

In another aspect, the invention is a press forming system including a paper-feeding subsystem having a first servo motor for delivering paper material from a bulk source. The press forming system also includes a blanking subsystem having a second servo motor for forming blanks from the paper material delivered by the paper-feeding subsystem. The press forming system also includes a forming die subsystem having a third servo motor for press forming the blanks into pressware. A programmable controller provides independent control of the first, second and third servo motors.

In still another aspect, the invention is a method of forming paperboard pressware, the method including the steps of forming a blank from a web of paperboard material, pressing the blank into a pressware article, and independently controlling a first servo motor associated with the step of forming a blank and a second servo motor associated with the step of pressing the blank.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of suitable embodiments of the invention, and are not restrictive of the invention, as claimed.

DETAILED DESCRIPTION OF EXAMPLE EMBODIMENTS

Figure 1:
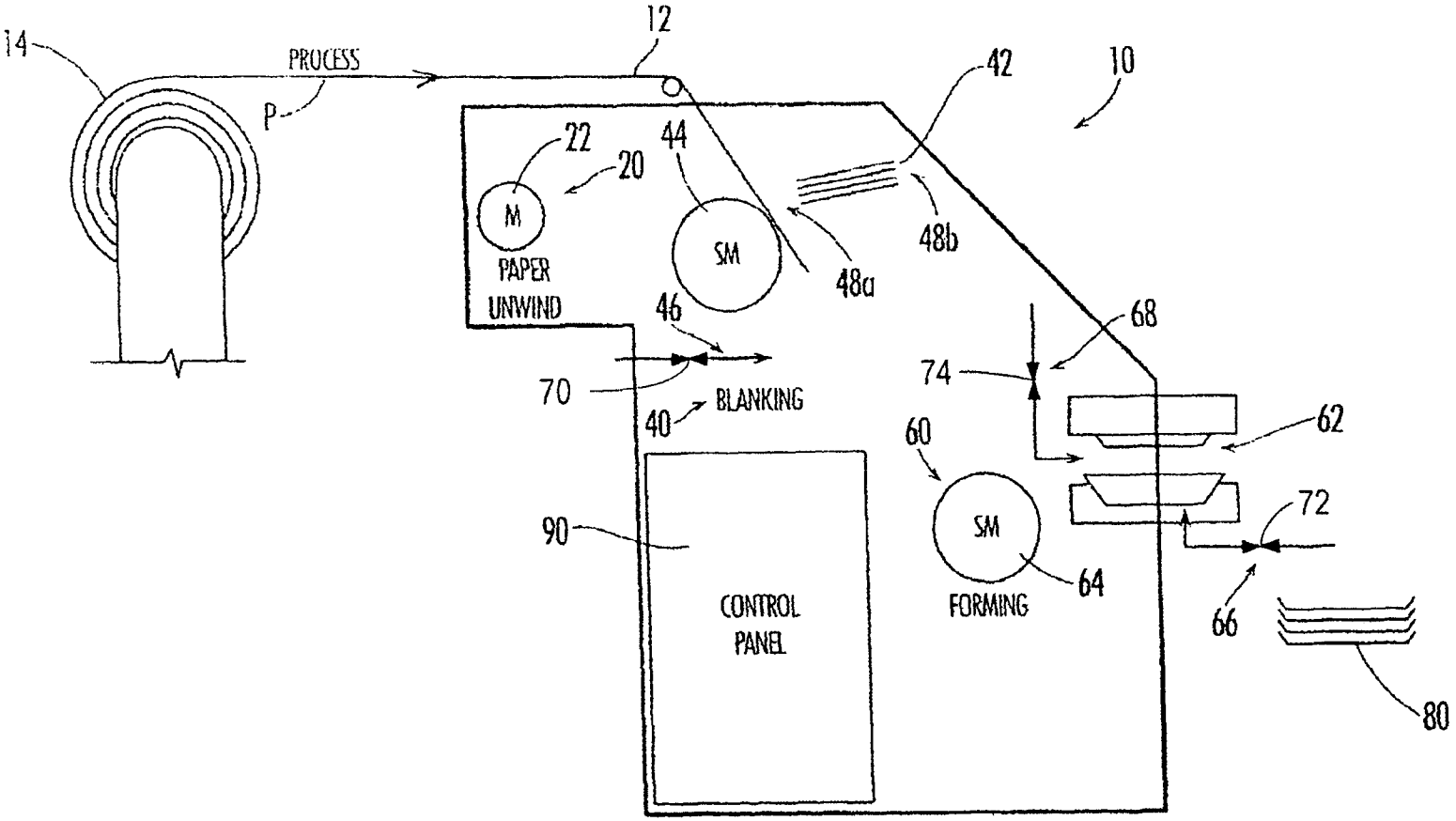
FIG. 1 is a side view of a press forming apparatus according to an example embodiment of the present invention.

The present invention may be understood more readily by reference to the following detailed description of the invention taken in connection with the accompanying drawing figures, which form a part of this disclosure. It is to be understood that this invention is not limited to the specific devices, dimensions or parameters described herein and/or shown in the drawing figures. Rather, the description and drawings provided are for the purpose of describing particular embodiments by way of example only, to assist in understanding the claimed invention, and are not intended to be limiting of the invention claimed. Also, the invention includes the overall systems and methods described herein, as well as the individual components and sub-combinations thereof, as claimed. As used herein, the singular forms "a," "an," and "the" are to be interpreted as including the plural, and reference to a particular numerical value includes at least that particular value, unless the context clearly dictates otherwise.

Figure 2:
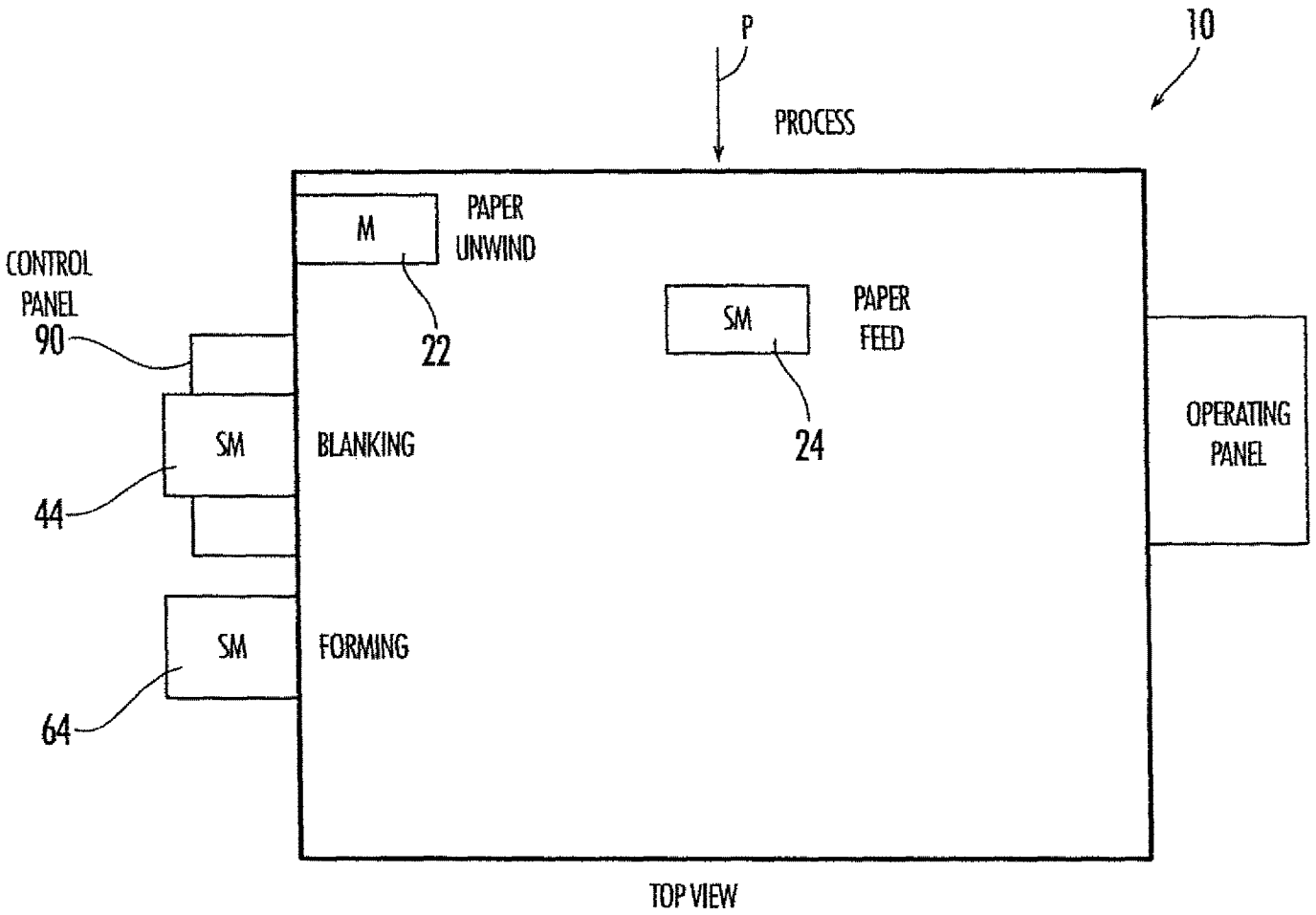
FIG. 2 is a top view of the press forming apparatus of FIG. 1.
Figure 3:
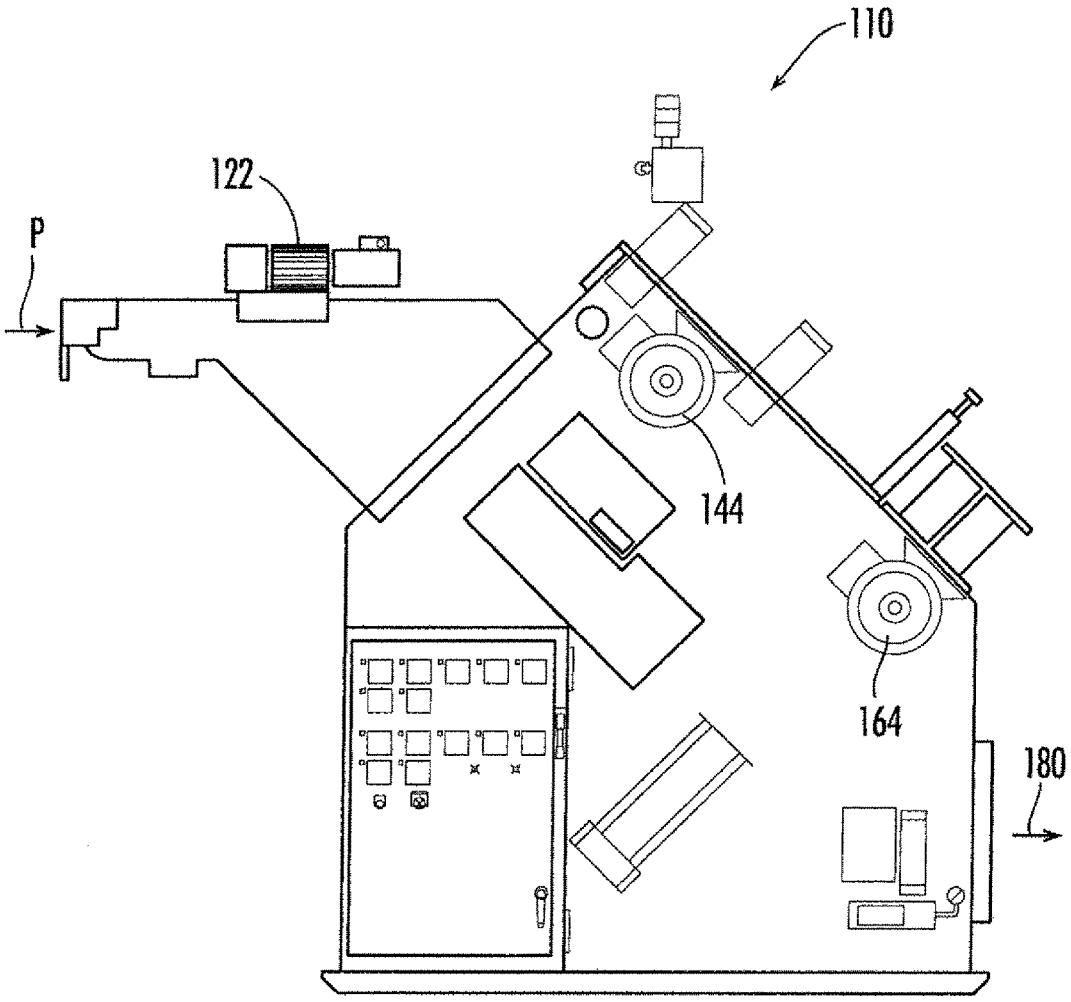
FIG. 3 is a first side view of a press forming apparatus according to another example embodiment of the present invention.
Figure 4:
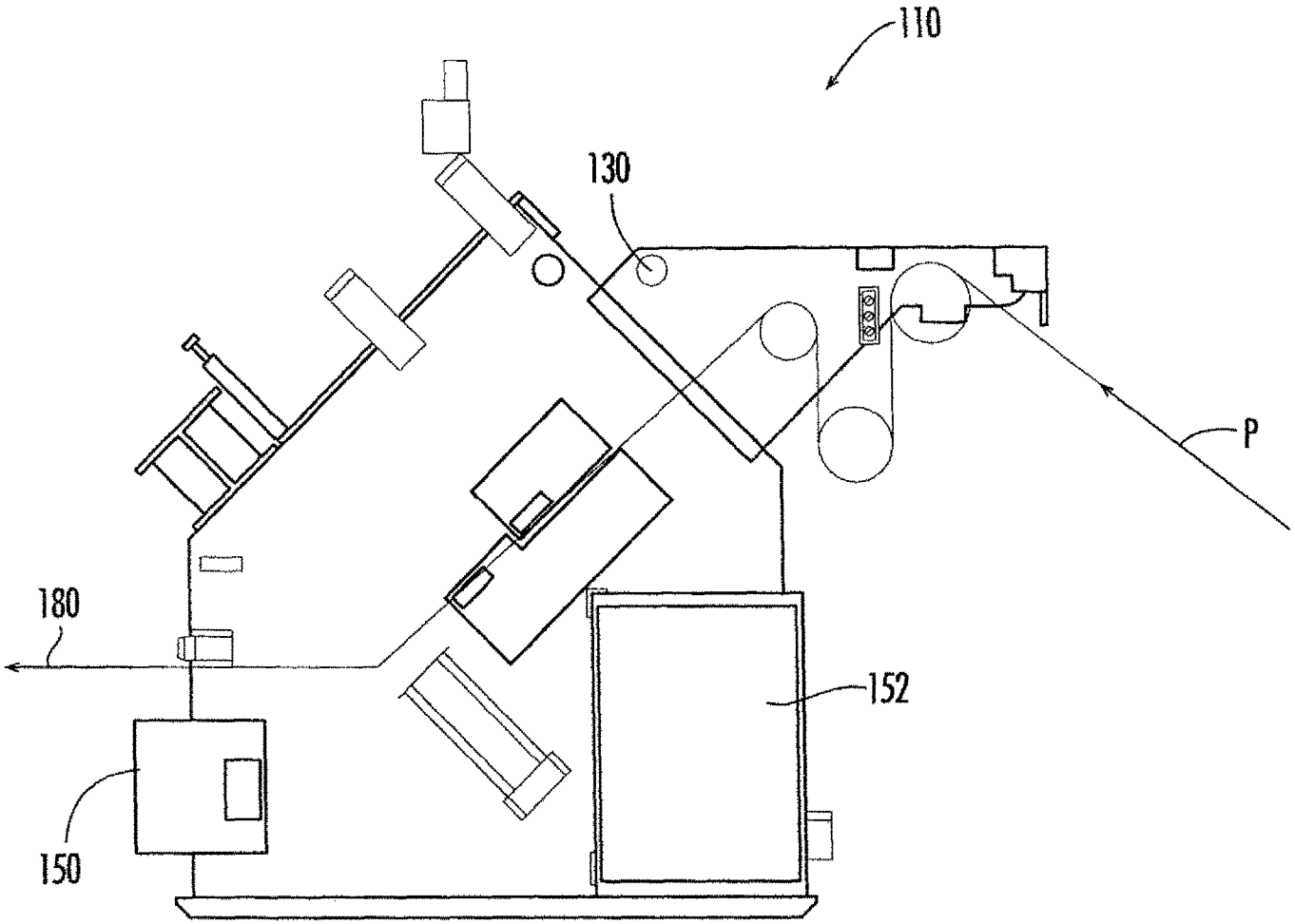
FIG. 4 is a second side view of the press forming apparatus of FIG. 3.
Figure 6:
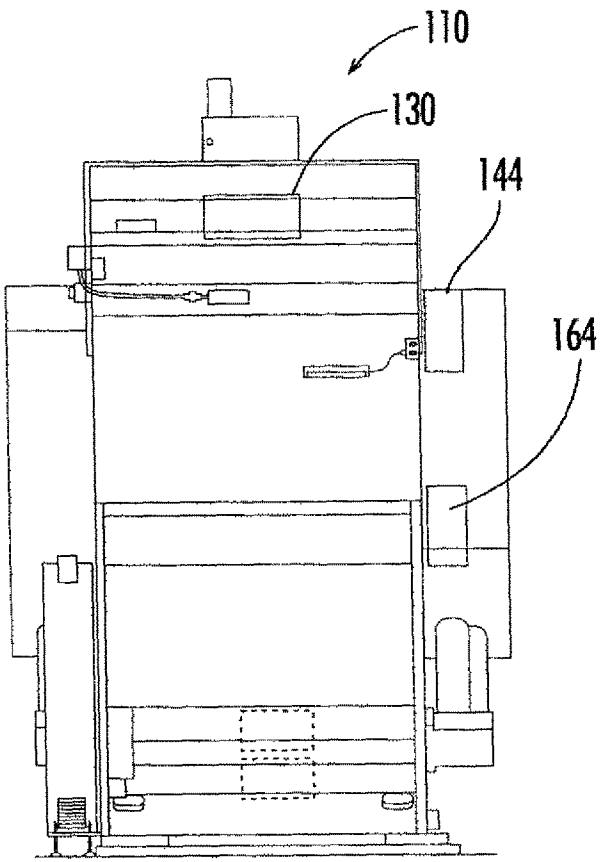
FIG. 6 is a back view of the press forming apparatus of FIG. 3.
Figure 5:
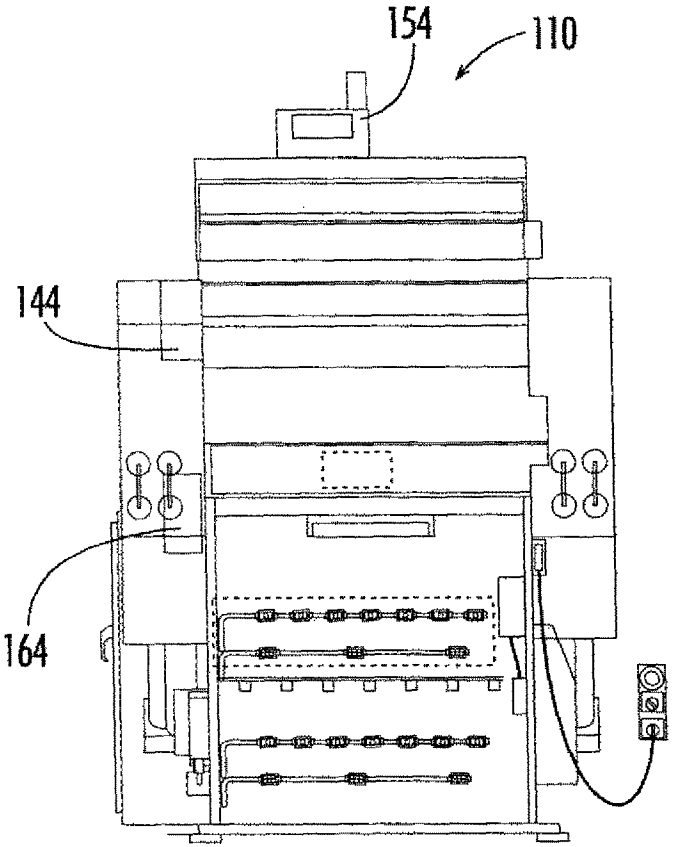
FIG. 5 is a front view of the press forming apparatus of FIG. 3.

An example embodiment of a press forming system 10 according to the present invention is shown in FIGS. 1 and 2. A web of paperboard 12 is delivered from a roll 14 carried on an unwind stand or other bulk source and fed in a process direction indicated by direction arrow P, via a paper-unwind subassembly 20, to a blanking subassembly 40. Paperboard blanks 42 formed by the blanking subassembly 40 are then fed to a press forming subassembly 60 to be formed into paperboard pressware articles 80, such as plates, bowls or the like. A control system 90 independently controls one or more actuators associated with the paper-unwind subassembly 20, the blanking subassembly 40, and/or the press forming subassembly 60 according to a specified sequence of operation.

The paper-unwind subassembly 20 can comprise one or more rollers, driveshafts or belts driven by a paper-unwind motor 22 to unwind paper from a roll 14 or otherwise deliver paper from another bulk source. Operation of the motor 22 is controlled by the programmable microprocessor-based control system 90, or by a dedicated controller. A servo motor, a stepper motor, a linear actuator, or other form of controllable actuator 24 is optionally provided to control feed of the web 12 of paperboard from the paper-unwind subassembly 20 to the blanking subassembly 40.

Paperboard blanks 42 are cut from the web 12 of paperboard by a reciprocating blanking die within the blanking subassembly 40. The blanking die is driven by a servo motor, a stepper motor, a linear actuator, or other form of controllable actuator 44. Optionally, blowout air 46 is delivered to discharge scrap from the blanking subassembly 40 resulting from the blanking operation. One or more intermediate stops 48*a*, 48*b* retain the blanks 42 for controlled feed to the forming subassembly 60.

The blanks 42 are gravity fed, or alternatively are fed by a servo motor-actuated transfer mechanism, into a space between the male punch and female die components of a forming press 62 of the forming subassembly 60. The forming press is driven by another servo motor, stepper motor, linear actuator, or other form of controllable actuator 64. Knockout air 66 is optionally delivered to release the formed pressware article from the die of the forming press 62, and/or discharge assist air 68 is delivered to remove the formed pressware article from the forming press for subsequent collection, counting, inspection and packaging.

FIGS. 3-6 show another example embodiment of a press-forming system 110 according to the present invention, which operates in substantially similar fashion to the embodiment described above. A paper unwind motor 122 draws a web of paperboard from an external bulk source in a process direction P. A paper feed servo 130 is controlled to deliver paperboard to the blanking die, which is driven by a blanking servo 144 to cut shaped paperboard blanks from the web of paperboard. The forming servo 164 drives the forming press to form the paperboard blanks into shaped paperboard pressware articles, which are subsequently discharged at a product output 180, for packaging, inspection or further processing. A control cabinet 150, control panel 152 and rate indicator 154 are optionally provided to allow local user interface, and/or to communicate with a remote monitoring and control system.

The computerized control system provides electronic control of the various component subsystems of the press-forming system 10, 110, including the paper-feed, blanking, forming, knockout air delivery, product-removal air assist delivery, and/or scrap-discharge blowout air delivery. In example form, the control system comprises a programmable microprocessor-based computer for executing software to carry out a specified sequence of operation of the various subassemblies of the press forming system and their components. The control system may further comprise one or more digital-to-analog converters, amplifiers, motor controllers, and/or other components for communicating signals to operate components of the press forming system according to software or user-input instructions. In this manner, the control system operates as an electronic or virtual "cam", providing control and monitoring of the various components and functions of the system in place of the mechanical cam-operated systems of previously known press forming systems.

Electronic monitoring and control of the press-forming system is optionally provided from a remote location via the computerized control system. Control from a remote location may provide monitoring of production and machine functions, and also allow adjustment of the individual settings of the various component subsystems of the press-forming system, as well as data collection and monitoring of production rate, output quality, and/or other system functions. The computerized control system also allows linking of the electronic monitoring and control of the press-forming system with monitoring and control of other production stations upstream and/or downstream from the press-forming system, such as packaging, printing and/or inspection stations, to provide centralized overall plant production monitoring and control, as well as process data collection, inventorying and reporting functions.

The control system preferably allows independent control of the various components and functions of the system, thereby improving timing and positional accuracy over previously known mechanical systems. For example, the control system can provide independent control of the paper feed servo, blanking servo, the forming servo, the paper-unwind motor, electronic actuators associated with the intermediate stops, and/or computer-controlled valves 70, 72, 74 associated with the scrap blowout air 46, the knockout air 66, and/or the discharge assist air 68, respectively. One or more servo drives may control the current delivered to the servo motors, and feedback control loops incorporating encoders or sensors associated with the servos and/or associated components enable proper positioning and delivery of torque and velocity to the respective subassembly components of the press forming system, according to the software or user-input instructions. The control system optionally also provides counting of the products produced by the press forming system.

Because the virtual cam provided by the control system of the present invention is not tied to mechanical restraints as in previously known systems, independent control of discrete aspects of the forming sequence is enabled. The forming servo, for example, may allow increasing or decreasing adjustment of dwell times in the forming press independently of other operations of the forming system. This can allow additional dwell time if needed to adequately form a product, while decreasing the time incurred in other steps of the product formation sequence, potentially increasing total machine output and/or improving product quality. Also, the stroke (or travel distance) of the forming ram can be independently controlled to provide just enough clearance for the plates to be popped out of the forming die in a "production stroke"; while providing a "maintenance stroke" with much greater clearance for replacing dies or performing other mechanical work inside the machine. Minimizing the production stroke in this manner may reduce cycle times and vibration, thereby increasing production rates and decreasing maintenance costs Operation of the blanking die can also be independently controlled by a software-implemented "virtual cam," to provide a much shorter stroke for production and a greater opening distance for maintenance. Timing of the delivery of knockout air for releasing formed product from the forming die, air assist for product removal from the forming die, scrap blowout air, and/or other production mechanisms is likewise controlled by the electronic "virtual" cam control system of the present invention. Overall, the motion and operation of the components of the various subassemblies can be better controlled to occur at more precisely prescribed times, keeping the machine in better synchronization.

As an additional advantage, in certain example embodiments of the invention, the forming and blanking servos can be mounted on the forming end and on the blanking end, respectively, of the press forming system. Such a mounting arrangement would eliminate the mechanical gear train presently inside known systems, and also eliminate the bull gears and pulleys presently used in connection with a single main motor.

While the invention has been described with reference to preferred and example embodiments, it will be understood by those skilled in the art that a variety of modifications, additions and deletions are within the scope of the invention, as defined by the following claims.

What is claimed is:

1. A press forming system comprising:

a blanking die for forming paperboard blanks, said blanking die being driven by a first actuator having closed loop feedback control;

a forming die for receiving the paperboard blanks from the blanking die and forming paperboard pressware, said forming die being driven by a second actuator having closed loop feedback control, wherein the first actuator is not mechanically linked to the second actuator in an operative manner whereby the first actuator does not drive the forming die and the second actuator does not drive the blanking die; and a control system providing independent control of the first and second actuators whereby the first actuator operates independently from the second actuator, wherein the control system controls a stroke length of the forming die, wherein the stroke length of the forming die during a production stroke is a first length, wherein the stroke length of the forming die during a maintenance stroke is a second length, and wherein the first length is less than the second length.

2. The press forming system of claim 1, wherein the first and second actuators are servo motors.

3. The press forming system of claim 1, further comprising a paper-feeding subassembly driven by a third actuator having closed loop feedback control, said third actuator being independently controllable by the control system.

4. The press forming system of claim 1, further comprising at least one valve for controlling release of knockout air to discharge a formed pressware article from the forming die, said at least one valve being controllable by the control system.

5. The press forming system of claim 1, further comprising at least one valve for controlling release of air assist delivery to transfer a formed pressware article from the forming die, said at least one valve being controllable by the control system.

6. A press forming system comprising:

a blanking die for forming paperboard blanks, said blanking die being driven by a first actuator having closed loop feedback control;

a forming die for receiving the paperboard blanks from the blanking die and forming paperboard pressware, said forming die being driven by a second actuator having closed loop feedback control, wherein the first actuator is not mechanically linked to the second actuator in an operative manner whereby the first actuator does not drive the forming die and the second actuator does not drive the blanking die;

a control system providing independent control of the first and second actuators whereby the first actuator operates independently from the second actuator, and at least one intermediate stop between the blanking die and the forming die, wherein the intermediate stop retains one or more blanks therebetween.

7. The press forming system of claim 6, further comprising a third actuator having closed loop feedback control, said third actuator being independently controllable by the control system.

8. The press forming system of claim 7, wherein the at least one intermediate stop is controlled by the third actuator.

9. The press forming system of claim 8, wherein the third actuator is a servo motor.

10. A press forming system comprising:

a blanking die for forming paperboard blanks, said blanking die being driven by a first actuator having closed loop feedback control;

a forming die for receiving the paperboard blanks from the blanking die and forming paperboard pressware, said forming die being driven by a second actuator having closed loop feedback control, wherein the first actuator is not mechanically linked to the second actuator in an operative manner whereby the first actuator does not drive the forming die and the second actuator does not drive the blanking die; and a control system providing independent control of the first and second actuators whereby the first actuator is configured to drive the blanking die and the second actuator is configured to drive the forming die at the same time and at different speeds with respect to one another, wherein the control system controls a stroke length of the forming die, wherein the stroke length of the forming die during a production stroke is a first length, wherein the stroke length of the forming die during a maintenance stroke is a second length, and wherein the first length is less than the second length.

11. The press forming system of claim 10, wherein the first and second actuators are servo motors.

12. The press forming system of claim 10, further comprising a paper-feeding subassembly driven by a third actuator having closed loop feedback control, said third actuator being independently controllable by the control system.

13. The press forming system of claim 10, further comprising at least one valve for controlling release of knockout air to discharge a formed pressware article from the forming die, said at least one valve being controllable by the control system.

14. The press forming system of claim 10, further comprising at least one valve for controlling release of air assist delivery to transfer a formed pressware article from the forming die, said at least one valve being controllable by the control system.

15. A press forming system comprising:

a blanking die for forming paperboard blanks, said blanking die being driven by a first actuator having closed loop feedback control;

a forming die for receiving the paperboard blanks from the blanking die and forming paperboard pressware, said forming die being driven by a second actuator having closed loop feedback control, wherein the first actuator is not mechanically linked to the second actuator in an operative manner whereby the first actuator does not drive the forming die and the second actuator does not drive the blanking die; and a control system providing independent control of the first and second actuators wherein the first actuator is configured to drive the blanking die at a first speed and the second actuator is configured to drive the forming die at a second speed, and wherein the first speed and the second speed are different from one another whereby the blanking die operates at a different speed than the forming die, wherein the control system controls a stroke length of the forming die, wherein the stroke length of the forming die during a production stroke is a first length, wherein the stroke length of the forming die during a maintenance stroke is a second length, and wherein the first length is less than the second length.

16. The press forming system of claim 15, wherein the first and second actuators are servo motors.

17. The press forming system of claim 16, further comprising a paper-feeding subassembly driven by a third actuator having closed loop feedback control, said third actuator being independently controllable by the control system.

18. The press forming system of claim 17, further comprising at least one valve for controlling release of knockout air to discharge a formed pressware article from the forming die, said at least one valve being controllable by the control system.

19. The press forming system of claim 17, further comprising at least one valve for controlling release of air assist delivery to transfer a formed pressware article from the forming die, said at least one valve being controllable by the control system.

20. A method for forming paperboard pressware, comprising:

introducing a paperboard feed to a press forming system comprising:

a blanking die for forming paperboard blanks, said blanking die being driven by a first actuator having closed loop feedback control;

a forming die for receiving the paperboard blanks from the blanking die and forming paperboard pressware, said forming die being driven by a second actuator having closed loop feedback control, wherein the first actuator is not mechanically linked to the second actuator in an operative manner whereby the first actuator does not drive the forming die and the second actuator does not drive the blanking die; and a control system providing independent control of the first and second actuators whereby the first actuator operates independently from the second actuator, wherein the control system controls a stroke length of the forming die, wherein the stroke length of the forming die during a production stroke is a first length, wherein the stroke length of the forming die during a maintenance stroke is a second length, and wherein the first length is less than the second length; and independently controlling one or more operational parameters of the first actuator and the second actuator.

21. The method of claim 20, further comprising introducing knockout air to the forming die to discharge the formed pressware article from the forming die.

22. The method of claim 20, further comprising introducing air assist delivery to transfer the formed pressware article from the forming die.

23. The method of claim 20, further comprising introducing scrap blowout air to the blanking die.

24. The method of claim 20, wherein the paperboard is introduced to the press forming system from a bulk source.

25. A press forming system comprising:

a blanking die for forming paperboard blanks, said blanking die being driven by a first actuator having closed loop feedback control;

a forming die for receiving the paperboard blanks from the blanking die and forming paperboard pressware, said forming die being driven by a second actuator having closed loop feedback control, wherein the first actuator is not mechanically linked to the second actuator in an operative manner whereby the first actuator does not drive the forming die and the second actuator does not drive the blanking die; and a control system providing independent control of the first and second actuators whereby the first actuator is configured to drive the blanking die and the second actuator is configured to drive the forming die at the same time and at different speeds with respect to one another, wherein the control system controls a stroke length of the blanking die and a stroke length of the forming die, and wherein the stroke length of the blanking die is a first length, the stroke length of the forming die is a second length, and the first length is less than the second length.

26. The press forming system of claim 25, wherein the first and second actuators are servo motors.

27. The press forming system of claim 25, further comprising a paper-feeding subassembly driven by a third actuator having closed loop feedback control, said third actuator being independently controllable by the control system.

28. The press forming system of claim 25, further comprising at least one valve for controlling release of knockout air to discharge a formed pressware article from the forming die, said at least one valve being controllable by the control system.

29. The press forming system of claim 25, further comprising at least one valve for controlling release of air assist delivery to transfer a formed pressware article from the forming die, said at least one valve being controllable by the control system.

30. A press forming system comprising:

a blanking die for forming paperboard blanks, said blanking die being driven by a first actuator having closed loop feedback control;

a forming die for receiving the paperboard blanks from the blanking die and forming paperboard pressware, said forming die being driven by a second actuator having closed loop feedback control, wherein the first actuator is not mechanically linked to the second actuator in an operative manner whereby the first actuator does not drive the forming die and the second actuator does not drive the blanking die;

a control system providing independent control of the first and second actuators whereby the first actuator operates independently from the second actuator, and at least one intermediate stop between the blanking die and the forming die, wherein the intermediate stop retains one or more blanks therebetween, wherein the control system controls a stroke length of the blanking die and a stroke length of the forming die, and wherein the stroke length of the blanking die is a first length, the stroke length of the forming die is a second length, and the first length is less than the second length.

31. The press forming system of claim 30, wherein the first and second actuators are servo motors.

32. The press forming system of claim 30, further comprising a paper-feeding subassembly driven by a third actuator having closed loop feedback control, said third actuator being independently controllable by the control system.

33. The press forming system of claim 30, further comprising at least one valve for controlling release of knockout air to discharge a formed pressware article from the forming die, said at least one valve being controllable by the control system.

34. The press forming system of claim 30, further comprising at least one valve for controlling release of air assist delivery to transfer a formed pressware article from the forming die, said at least one valve being controllable by the control system.

* * * * *